US005377754A

United States Patent [19]

Keller

[11] Patent Number: 5,377,754

[45] Date of Patent: Jan. 3, 1995

[54] PROGRESSIVE FLUID SAMPLING FOR BOREHOLES

[76] Inventor: Carl E. Keller, P.O. Box 10129, Santa Fe, N. Mex. 87504-0129

[21] Appl. No.: 204,876

[22] Filed: Mar. 2, 1994

[51] Int. Cl.[6] ..... E21B 49/08

[52] U.S. Cl. ..... 166/264; 166/50; 166/72; 166/191

[58] Field of Search ..... 166/264, 250, 50, 113, 166/191, 72

[56] References Cited

U.S. PATENT DOCUMENTS

| | | | |
|---|---|---|---|
| 2,927,775 | 3/1960 | Hildebrandt | 175/245 X |
| 4,522,125 | 6/1985 | Marz | 166/63 X |
| 5,176,207 | 1/1993 | Keller | 166/64 |
| 5,287,741 | 2/1994 | Schultz et al. | 166/264 X |
| 5,293,931 | 3/1994 | Nichols et al. | 166/264 X |

*Primary Examiner*—Hoang C. Dang

[57] ABSTRACT

An everting membrane assembly defines a constant volume for traveling along a generally horizontal borehole, pipe, or the like, having two accessible ends, for sampling within the borehole on a continuous basis. A first everting membrane carries an extraction tube through the borehole. A second everting membrane contains a perforated pipe for attachment to the extraction tube. As the first membrane is inverted back through the borehole, the second membrane is everted, forming a sampling volume therebetween with the perforated pipe exposed in the sampling volume for withdrawing fluids through the extraction tube for analysis.

5 Claims, 3 Drawing Sheets

PROGRESSIVE FLUID SAMPLING FOR BOREHOLES

BACKGROUND OF THE INVENTION

This invention relates to everting membrane sampling devices and, more particularly, to everting membrane devices forming a progressive sampling volume along a borehole, pipe, or the like.

There are many instances where it is desired to progressively sample within a borehole, pipe, or the like, to determine a profile of fluids or fluid material in the borehole. It is also necessary to sometimes isolate a section of the borehole for fluid extraction or injection. These operations are done conventionally using straddle packers that are inserted to the desired position in the borehole and then expanded to seal against the borehole wall, leaving an exposed section of the borehole for sampling and/or isolation.

Straddle packers can be trapped in a borehole by material sloughing from the side of the borehole. Indeed, the action of the straddle packer can cause a slough that traps the device. This problem is aggravated in horizontal boreholes where the device may be supported by one side of the borehole during insertion and withdrawal, with concomitant wear and slough from the borehole wall.

Another problem with straddle packers is that each interval to be sampled or isolated requires a discrete placement of the packer. Each movement requires a retraction of the sealing members at an existing location and expansion of the members at a new location. It will be appreciated that this is a time consuming operation and each movement of the packer is subject to sloughing of the borehole wall.

U.S. Pat. No. 5,176,207, incorporated herein by reference, teaches an everting membrane system that overcomes many of the problems of straddle packers in movement through a borehole. The everting membrane "rolls" along the borehole wall and is not prone to cause sloughing of the wall and is relatively easy to remove if sloughing does occur since the membrane is flexible. As taught in the '207 patent, the everting membrane may be provided with absorbent material or sample volumes at discrete locations along the membrane, but these features must be prefabricated for use at predetermined locations along the borehole.

Accordingly, it would be desirable to provide for a continuous and progressive isolation and/or sampling along a borehole, pipe, or the like. This problem is addressed by the present invention and an everting membrane design enables a traveling sample/isolation volume to be defined.

It is one object of the present invention to provide a traveling sample/isolation volume.

It is another object of the present invention to provide for sampling along a traveling sample volume.

One other object of the present invention is to provide a traveling sample system to obtain a continuous plot of the material permeability and fluid properties along a borehole.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims

SUMMARY OF THE INVENTION

To achieve the foregoing and other objects, and in accordance with the purposes of the present invention, as embodied and broadly described herein, the apparatus of this invention may comprise a sampling everting membrane assembly for defining a traveling volume in a borehole having first and second open ends. A first everting membrane assembly includes a sample extraction tube extending outwardly through a closed end of said first membrane assembly when everted. A second everting membrane assembly includes a perforated tube for attaching to the sample extraction tube and extends beyond the second membrane assembly when the second membrane assembly is inverted.

In another characterization of the present invention, a method provides for continuously sampling along a borehole with first and second accessible ends. A first everting membrane is disposed through the first end of the borehole. A second everting membrane is disposed through the second end of the borehole in operable proximity to the first everting membrane to define a sampling volume therebetween. The first everting membrane is then inverted while the second everting membrane is everted to continuously move the sampling volume through the borehole.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE DRAWINGS

Figure 1A:
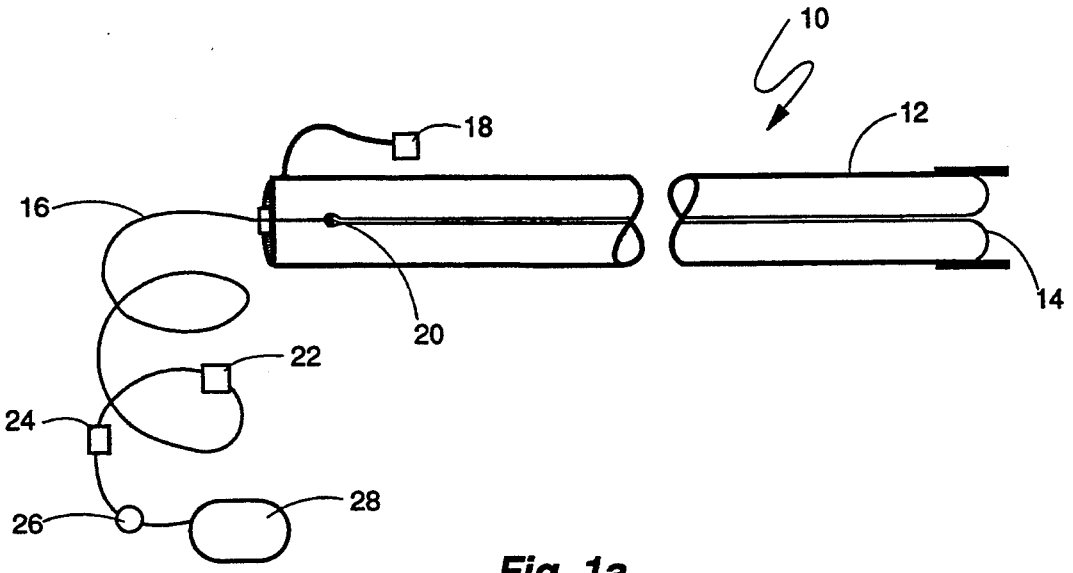
FIGS. 1A and 1B pictorially illustrate in partial cross section first and second everting membrane assemblies, respectively, forming a sampling everting membrane assembly for defining a traveling volume within a borehole according to the present invention.
Figure 1B:
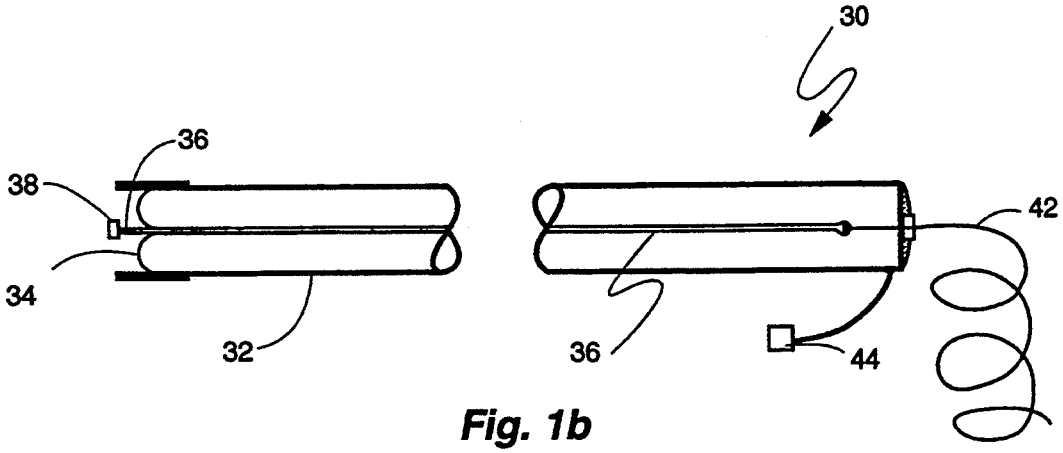

Referring first to FIGS. 1A and 1B, there is depicted first everting membrane assembly 10 and second everting membrane assembly 30 for defining and forming a constant traveling volume within a borehole, pipe, or the like. As used herein, the term "borehole" will be construed to mean a borehole through the earth, a pipe, or similar cylindrical volume, having two open and accessible ends, i.e., a generally horizontal borehole geometry. As hereinafter more fully explained, membrane 14 everts through a borehole and is operably connected to inverted membrane 34. As membrane 14 is inverted, membrane 34 everts to form a constant volume therebetween that traverses the borehole.

FIG. 1A more particularly illustrates a first everting membrane assembly 10 including a first hose canister 12 for containing membrane 14. Extraction tube 16 is connected 20 to membrane 14 to permit material to be withdrawn from the borehole when membrane 14 is wholly or partially everted. Extraction tube 16 extends through the end of canister 12 and may also serve as a tether for inverting membrane 14 from a borehole to within canister 12. Pressurizing pump 18 is connected to canister 12 to inflate canister 12 for everting membrane 14 into a borehole.

A variety of devices may be functionally connected to extraction tube 16 to provide for sampling materials within the traveling volume. Analyzer 22 may be provided for detecting temperature, pressure, viscosity, and the like, of the material to form a profile of material characteristics along the borehole. Flow meter 24 may be provided to determine the quantity of fluid extracted from the borehole. A storage tank 28 provides for the collection of fluids for additional analysis. Extraction pump 26 creates a reduced pressure within extraction tube 16 to cause a fluid flow from within a borehole through tube 16.

FIG. 1B illustrates a second everting membrane assembly 30 with membrane 34 inverted within canister 32. In one embodiment, perforated pipe 36 extends along the length of inverted membrane 34 with connector 38 projecting beyond the end of inverted membrane 34 for connecting to connection 20 of extraction tube 16 when membrane 14 is fully everted (see FIG. 1A). Tether 42 is connected to the closed end of membrane 34 and extends through canister 32 for inverting membrane 34 within canister 32. Pressure pump 44 is connected for inflating canister 32 and everting membrane 34 into an adjacent borehole.

Hose canisters 12 and 32 may be preferably formed from flexible fabrics that are light-weight and that can be easily maneuvered for connecting to a borehole opening. However, membrane assemblies 10 and 30 may also be formed with reel canister assemblies as described in the '207 patent with some adaptation to permit sampling from within the borehole as membrane 14 is wound onto a reel.

Figure 2:
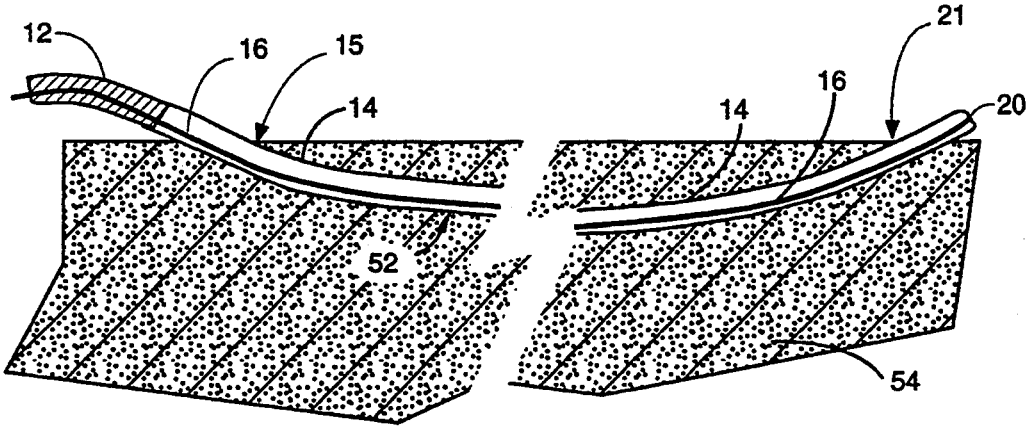
FIG. 2 pictorially illustrates a first everting membrane assembly everted through a borehole for connection to a second everting membrane assembly.
Figure 3:
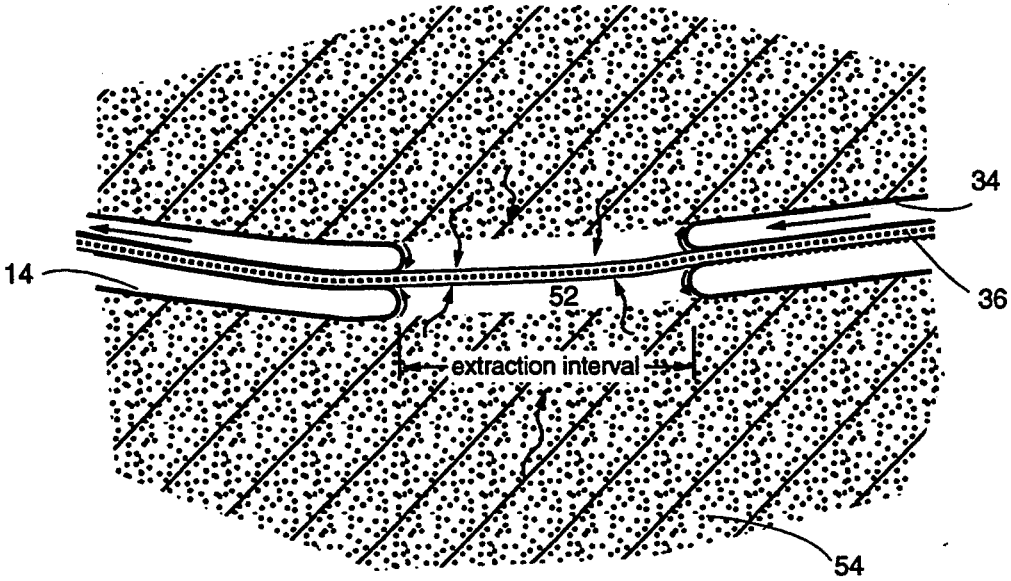
FIG. 3 pictorially illustrates in partial cross-section the first and second everting membranes forming traveling constant volume with exposed perforated pipe for sampling the volume.

FIGS. 2 and 3 pictorially illustrate the general operation of the everting membrane assemblies described in FIGS. 1A and 1B, above. As shown in FIG. 2, horizontal borehole 52 is disposed in earth formation 54. A first everting membrane assembly 10 (FIG. 1A) is disposed with canister 12 abutting a first entrance 15 to borehole 52. Membrane 14 is everted through borehole 52 to extend through a second opening 21 of borehole 52 wherein connection 20 protrudes for connection to perforated tube 36 of a second everting membrane assembly 30 (FIG. 1B). Extraction tube 16 is operatively terminated in connection 20, which may, for example, be a bolted flange connection, a bayonet-type connection, or other suitable means for connecting extraction tube 16 and perforated tube 36, and extends through canister 12 as shown in FIG. 1A.

FIG. 3 depicts the inversion of membrane 14 back through borehole 52 into canister 12. Perforated tube 36 is connected to extraction tube 16 (FIG. 2) and is shown partially withdrawn within inverting membrane 14 from everting membrane 34. A traveling extraction volume is formed between inverting membrane 14 and everting membrane 34 where the volume is open to earth formation 54. The extraction volume moves along borehole 52 and fluid samples are extracted through perforated tube 36 to enable a profile to be formed of the fluid composition in earth formation 54 defining borehole 52. The extraction volume remains constant during the transit of borehole 52.

Referring to the everting membrane assemblies 10 and 30 shown in FIGS. 1A and 1B, respectively, extraction pump 26 draws through extraction tube 16 to drop pressure in perforated tube 36 via connection 20. Since perforated tube 36 is sealed by first membrane 14 and second membrane 34 over most of its length, perforated tube 36 reduces the fluid pressure in the extraction interval between membranes 14 and 34. As a consequence, fluid (gas and/or liquid) is drawn from the exposed portion of perforated tube 36 to establish a fluid flow through extraction tube 16.

Fluid flow rate may be measured by flow meter 24. Flow composition may be measured by analyzer 22, e.g., a gas chromatograph. The rate of advance of the extraction volume is determined by extraction tube 16 withdrawal from hose canister 12. The rate is adjusted to provide a desired flow measurement and fluid analysis. The advance can be continuous or periodic depending on the desired fluid flow.

When membrane 14 is fully inverted within canister 12, perforated tube 36 has traveled the full length of borehole 52. Likewise, the extraction interval has traveled the full length of borehole 52. The flow rate may be measured and plotted against the extraction interval location, determined from the length of extraction tube 16 withdrawn from canister 12 to provide continuous data related to the effective permeability along borehole 52. In a vadose zone, the permeability is a measure of the gas permeability. In a saturated zone, the permeability is a measure of the water permeability. A contaminate concentration can be plotted in a like manner to identify zones of contamination along borehole 52.

Figure 4A:
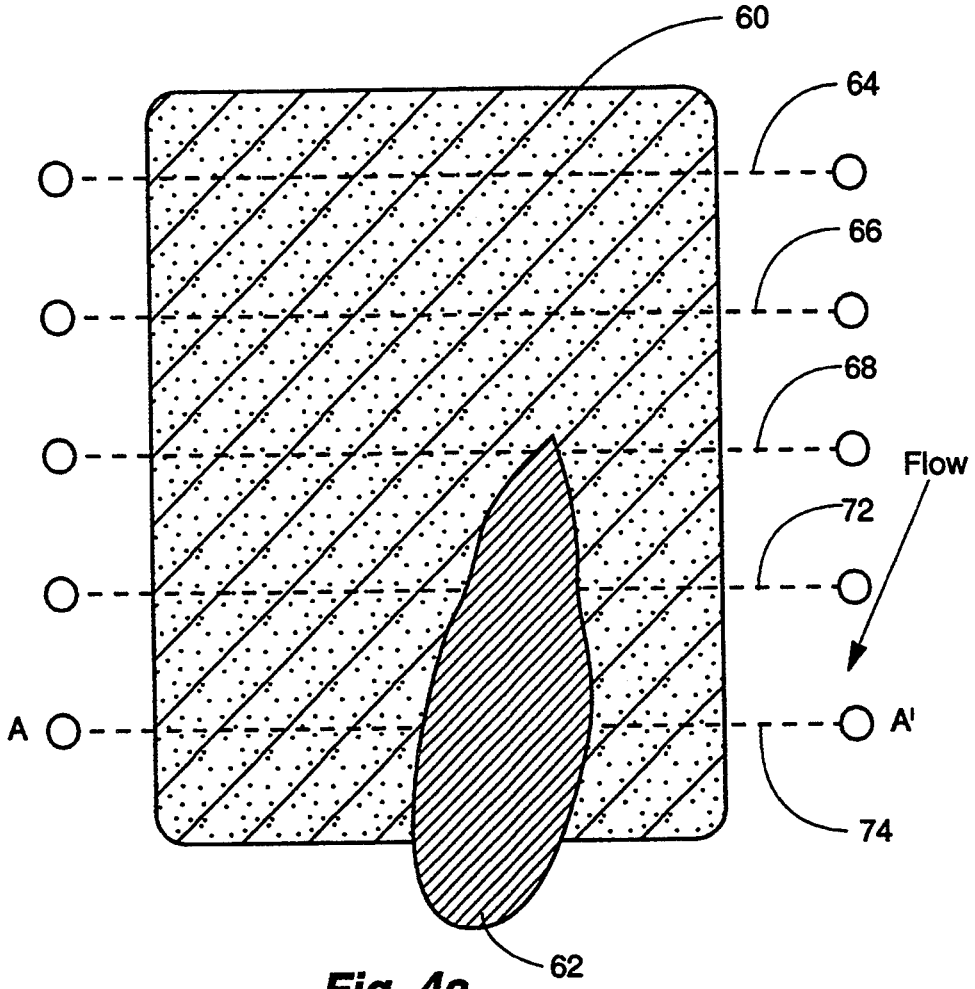
FIGS. 4A and 4B illustrate in plan view and cross-sectional view, respectively, application of a sampling membrane assembly to mapping conditions beneath a landfill or other waste area location.
Figure 4B:
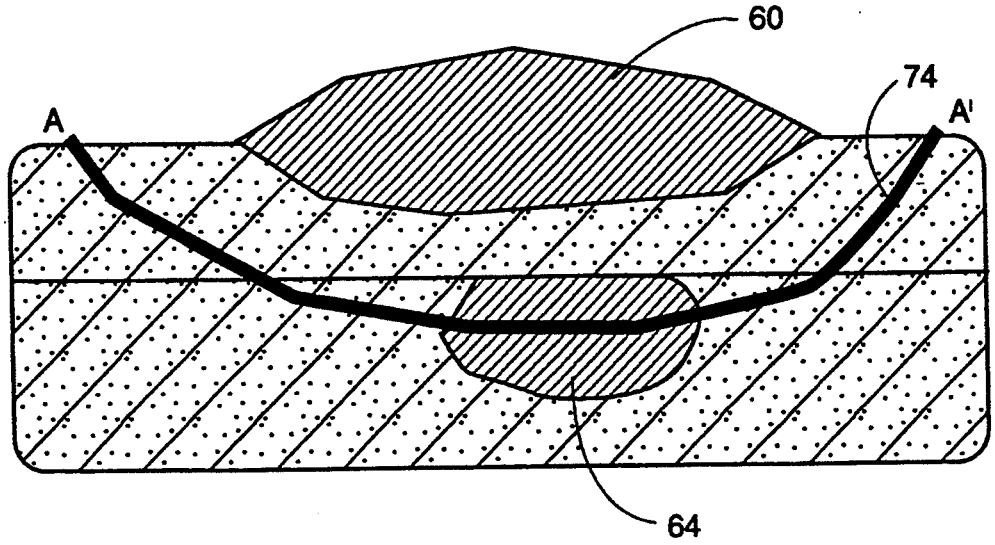

FIGS. 4A and 4B illustrate an application of the present invention to mapping contamination of soil and ground water. The everting membrane assemblies 10 and 30 (FIGS. 1A and 1B) provide a continuous and traveling extraction volume while sealing and supporting the borehole. As herein described, a particular application is the measurement of leachate leakage from a landfill.

As shown in FIG. 4A, boreholes 64, 66, 68, 72, and 74 are placed beneath a zone having a leachate to be monitored, e.g., landfill 60. As the extraction interval traverses beneath landfill 60, the existence and dimensions of a contamination plume 64 are readily determined. In addition, the composition of the leachate in plume 64 and relative permeability of material traversed by plume 64 are easily measured.

In another application, an open-ended pipe forms a transit path rather than a borehole and a vacuum can be applied to the extraction interval as it traverses the length of the pipe, e.g., a coolant return line of a nuclear reactor. If the extraction interval passes a section of pipe that leaks, the vacuum in the extraction interval is degraded and readily detected via the extraction tube. The ability of the everting/inverting membranes to seal pipes of various sizes and curvatures makes the traveling extraction volume described herein a useful monitor for a variety of pipe applications. Thus, as used herein, the term "borehole" includes open-ended ducts and pipes through which the sampling membrane assembly described above can be employed.

The foregoing description of preferred embodiments of the invention have been presented for purposes of illustration and description. It is not intended to be exhaustive or to limit the invention to the precise form disclosed, and obviously any modifications and variations are possible in light of the above teaching. The embodiments were chosen and described in order to best explain the principles of the invention and its practical applications to thereby enable others skilled in the art to best utilize the invention in various embodiments and with various modifications as are suited to the particular use contemplated. It is intended that the scope of the invention be defined by the claims appended hereto.

What is claimed is:

1. A sampling membrane assembly for defining a traveling volume within a borehole having first and second open ends, comprising:

a first everting membrane assembly including a sample extraction tube extending outwardly through a closed end of said first membrane assembly when everted; and a second everting membrane assembly including a perforated tube for attaching to said sample extraction tube and extending beyond said second membrane assembly when inverted.

2. A sampling membrane assembly according to claim 1, wherein said sample extraction tube and said first everting membrane assembly and said second everting membrane assembly define said traveling volume about said perforated tube when said first membrane assembly is inverted as said second membrane assembly is everted.

3. A sampling membrane assembly according to claim 1, further including pump means attached to said extraction tube for withdrawing fluid from within said traveling volume defined in said borehole.

4. A method for continuously sampling along a borehole, having first and second accessible ends, comprising the steps of:

disposing a first everting membrane through said first end;

disposing a second everting membrane through said second end in operable proximity to said first everting membrane to define a sampling volume therebetween; and inverting said first everting membrane while everting said second everting membrane to continuously move said sampling volume through said borehole.

5. A method according to claim 4, further including the step of withdrawing fluid from within said sampling volume during movement of said sampling volume through said borehole.

* * * * *